US009330858B2

(12) United States Patent
Boeck et al.

(10) Patent No.: US 9,330,858 B2
(45) Date of Patent: May 3, 2016

(54) POWER TOOL

(71) Applicant: Robert Bosch GmbH, Stuttgart (DE)

(72) Inventors: Cornelius Boeck, Kirchheim (DE); Daniel Barth, Leinfelden-Echterdingen (DE); Sinisa Andrasic, Schoenaich (DE); Joachim Schadow, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 23 days.

(21) Appl. No.: 14/368,002

(22) PCT Filed: Nov. 15, 2012

(86) PCT No.: PCT/EP2012/072761

§ 371 (c)(1),
(2) Date: Jun. 23, 2014

(87) PCT Pub. No.: WO2013/092029

PCT Pub. Date: Jun. 27, 2013

(65) Prior Publication Data

US 2014/0370792 A1 Dec. 18, 2014

(30) Foreign Application Priority Data

Dec. 23, 2011 (DE) ..... 10 2011 089 726

(51) Int. Cl.
*B24B 23/02* (2006.01)
*H01H 3/20* (2006.01)
(Continued)

(52) U.S. Cl.
CPC ..... *H01H 3/20* (2013.01); *B24B 23/028* (2013.01); *H01H 9/06* (2013.01); *H01H 21/10* (2013.01)

(58) Field of Classification Search
CPC ..... B24B 23/028; H01H 3/20; H01H 9/06; H01H 21/20
USPC ..... 451/358, 359, 344, 360; 173/170, 216, 173/217
See application file for complete search history.

(56) References Cited

U.S. PATENT DOCUMENTS 2,450,380 A * 9/1948 Perham ..... H01H 21/10 173/170
5,201,146 A * 4/1993 Fushiya ..... B23D 45/16 451/358

(Continued)

FOREIGN PATENT DOCUMENTS

| | | | |
|---|---|---|---|
| DE | 197 07 215 | A1 | 9/1997 |
| DE | 10 2004 038 788 | A1 | 2/2006 |
| DE | 10 2009 027 871 | A1 | 1/2011 |
| EP | 0 750 837 | A1 | 1/1997 |
| EP | 2 101 340 | A1 | 9/2009 |

OTHER PUBLICATIONS

International Search Report corresponding to PCT Application No. PCT/EP2012/072761, mailed Jul. 22, 2013 (German and English language document) (5 pages).

*Primary Examiner* — George Nguyen
(74) *Attorney, Agent, or Firm* — Maginot, Moore & Beck LLP

(57) ABSTRACT

A power tool, especially an angle grinder, includes at least one grip housing, at least one switching unit that has at least one latch element arranged on the grip housing, and at least one bearing unit configured to mount the latch element such that it is mobile at least with respect to the grip housing. When the latch element is actuated, the bearing unit is configured to guarantee a stroke movement of the latch element along a trajectory of a value greater zero, starting from an end of the latch element closer to the connecting region of the grip housing in the direction of an end of the latch element away from the connecting region, which end is configured to be gripped.

20 Claims, 9 Drawing Sheets

(51) Int. Cl.
*H01H 9/06* (2006.01)
*H01H 21/10* (2006.01)

(56) References Cited

U.S. PATENT DOCUMENTS 5,407,381 A * 4/1995 Schaefer ..... B25F 5/02 451/344
5,681,214 A * 10/1997 Kleider ..... B23D 45/16 451/344
6,602,122 B1 * 8/2003 Rudolf ..... B24B 23/005 451/344
D564,321 S * 3/2008 Huguet ..... D8/62
7,537,065 B2 * 5/2009 Gallagher ..... B24B 23/02 173/170
D623,909 S * 9/2010 Tate ..... D8/8

* cited by examiner

POWER TOOL

This application is a 35U.S.C §317 National Stage Application of PCT/EP 2012/072761, filed on Nov. 15, 2012, which claims the benefit of priority to Serial. No. DE 10 2011 089 726.7, filed on Dec. 23, 2011 in Germany, the disclosures of which are incorporated herein by reference in their entirety.

BACKGROUND

Already known from DE 197 07 215 A1 is a power tool, in particular an angle grinder, which comprises a handle housing, a switching unit that has a latch element arranged on the handle housing, and which comprises a bearing unit, which is provided for mounting the latch element so as to be at least movable relative to the handle housing.

SUMMARY

The diclosure is based on a power tool, in particular an angle grinder, comprising at least one handle housing, comprising at least one a switching unit that has at least one latch element arranged on the handle housing, and comprising at least one bearing unit, which is provided for mounting the latch element so as to be at least movable relative to the handle housing.

It is proposed that the bearing unit be provided to ensure a travel movement of the latch element along a distance having a value of greater than zero in every case, upon an actuation of the latch element, starting from an end of the latch element that faces toward a connecting region of the handle housing, in the direction of a further end of the latch element that can be gripped and that faces away from the connecting region. The power tool is preferably realized as a portable power tool, in particular as a portable, hand-held power tool. A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 7 kg. Particularly preferably, the portable power tool is realized as an angle grinder. It is also conceivable, however, for the portable power tool to be of a different design, considered appropriate by persons skilled in the art, such as, for example, designed as a hammer drill and/or chipping hammer, power drill, saber saw, compass saw, hedge shears, etc.

A "handle housing" is to be understood here to mean, in particular, at least one housing or at least one housing sub-region that, to a large extent, is dissociated from a mounting of a drive unit and/or output unit of the power tool, wherein at least one grip region of the housing or of the housing sub-region, in particular a housing sub-region realized as a stem-type grip region, can be gripped by an operator, by at least one hand, at least to a large extent, for the purpose of handling the power tool. The expression "can be gripped to a large extent" is intended here to define, in particular, a capability whereby a component or a component region can be gripped by a hand of an operator along at least more than 70%, preferably more than 80%, and particularly preferably more than 90% of a total extent of a total outer circumference of the component or of the component region that runs in a plane extending at least substantially perpendicularly in relation to a direction of longitudinal extent of the component or of the component region, wherein the total extent of the total circumference is, in particular, less than 40 cm, preferably less than 30 cm, and particularly preferably less than 25 cm. Preferably, when the component or component region is gripped, a hand inner surface and finger inner surfaces of the hand of the operator bear on the total outer circumference at least along a distance greater than 70%, preferably greater than 80%, and particularly preferably greater than 90% of the total extent of the total outer circumference. Preferably, the handle housing is realized so as to be separate from a drive housing of the power tool that is provided to accommodate the drive unit and/or output unit, in order to support drive bearing forces and/or output bearing forces. It is also conceivable, however, for the handle housing and the drive housing to be realized as a single piece.

Preferably, the handle housing has a stem-type grip region. The expression "stem-type grip region" is intended here to define, in particular, a housing sub-region of the handle housing that, as viewed in a longitudinal sectional plane, in which the direction of main extent of the power tool extends, along a direction running at least substantially perpendicularly in relation to the direction of main extent, has a maximum extent, in particular, of less than 10 cm, preferably of less than 8 cm, and particularly preferably of less than 6 cm, wherein at least one operating surface of the handle housing is arranged in the housing sub-region of the handle housing. Preferably, the maximum extent, as viewed in the longitudinal sectional plane, is delimited by at least two parallel straight lines, or by at least two straight lines, inclined relative to each other by an angle of less than 10°, preferably of less than 8°, and particularly preferably of less than 6°, that are constituted by an outer contour of the housing sub-region of the handle housing. The stem-type grip region is inclined relative to a direction of main extent of the power tool, in particular, at least by an angle of less than 60°, preferably of less than 40°, and particularly preferably of less than 30°.

Preferably, the stem-type grip region, as viewed along a rotation axis of a drive element, in particular of an armature shaft, a drive unit of the power tool, and in particular along the direction of main extent of the power tool, is arranged behind the drive unit. Moreover, it is conceivable for the handle housing, in addition to having the stem-type grip region, to have a bow-shaped sub-region, which is integrally formed on to the stem-type grip region. The bow-shaped sub-region may preferably be of an L-shaped design, which extends in an L shape in the direction of the connecting region, starting from an end of the stem-type grip region that faces away from the connecting region of the handle housing. Particularly preferably, the handle housing comprises at least two handle housing shell elements, which can be joined to each other in a joint plane. The handle housing thus preferably has a shell-type structure. It is also conceivable, however, for the handle housing to have a pot-type structure.

The term "switching unit" is intended there to define, in particular, a unit having at least one component, in particular the latch element, which can be actuated directly by an operator, and which is provided to influence and/or alter a process and/or a state of a unit coupled to the switching unit, through an actuation and/or through an input of parameters. The latch element is preferably provided for actuating at least one switching element of the switching unit. A "latch element" is to be understood here to mean, in particular, an operating element that, along a direction of longitudinal extent of the operating element, has a longitudinal extent that is greater than a transverse extent of the operating element that runs at least substantially perpendicularly in relation to the direction of longitudinal extent and runs at least substantially transversely in relation to a main direction of movement of the operating element. "Substantially transversely" is to be understood here to mean, in particular, an alignment of a direction and/or of an axis relative to a reference direction and/or to a reference axis, wherein the alignment of the direction and/or of the axis are at least different from an at least substantially parallel alignment in relation to the reference direction and/or to the reference axis and, in particular, are askew or perpendicular in relation to the reference direction and/or to the reference axis. Preferably, a maximum longitudinal extent of the latch element is at least 2 times greater, preferably at least 4 times greater, and particularly preferably at least 6 times greater than a maximum transverse extent of the latch element. The latch element has, in particular, a maximum longitudinal extent that is greater than 3 cm, preferably greater than 6 cm, and particularly preferably greater than 8 cm. In addition, the latch element preferably comprises an operating surface, in particular an operating surface constituted by a grip surface region of the latch element, on which an operator can place at least three fingers in order to actuate the latch element, and which has at least one longitudinal extent that is greater than 5 cm, running along the direction of longitudinal extent of the latch element.

The expression "substantially perpendicularly" is intended here to define, in particular, an alignment of a direction relative to a reference direction, wherein the direction and the reference direction, in particular as viewed in one plane, enclose an angle of 90° and the angle has a maximum deviation of, in particular, less than 8°, advantageously less than 5°, and particularly advantageously less than 2°. Preferably, the switching unit is provided to actuate the switching element by means of an actuation of the latch element, in order to open or close an electric circuit for supplying energy, at least to a drive unit of the power tool. The switching unit is thus preferably provided to enable the power tool to be put into operation or deactivated. "Provided" is to be understood to mean, in particular, specially designed and/or specially equipped. The switching element is preferably constituted by a mechanical, electrical and/or electronic switching element.

The term "bearing unit" is intended here to define, in particular, a unit provided to limit a number of degrees of freedom of movement of at least one component, wherein the unit has at least one bearing element that enables the component to be moved in a guided manner along and/or about at least one movement axis of the component. The bearing unit in this case may be realized as a translational bearing unit and/or as a rotational bearing unit. Particularly preferably, the bearing unit is realized as a rotational bearing unit. Moreover, the expression "connecting region" is to be understood here to mean, in particular, a region of the handle housing via which the handle housing is connected to the drive housing in a form closed, force closed and/or materially bonded manner, or by means of which the handle housing bears directly against the drive housing. An "end of the latch element that faces toward the connecting region" is to be understood here to mean, in particular, an arrangement of points of the latch element, in respect of a central plane of the latch element, that runs at least substantially perpendicularly in relation to the direction of longitudinal extent of the latch element, and that is arranged at least substantially equally from two ends of the latch element that are spaced apart from each other along the direction of longitudinal extent of the latch element, wherein all points of the latch element, that are arranged, starting from the central plane, in the direction of the connecting region, as viewed along the direction of longitudinal extent of the latch element, are considered to face toward the connecting region. Thus, preferably, all points of the latch element that are arranged, starting from the central plane of the latch element, along a direction away from the connecting region, as viewed along the direction of longitudinal extent of the latch element, are considered to face away from the connecting region. It is conceivable in this case for the end of the latch element that faces toward the connecting region to be dissociated from a travel movement in a bearing point at which at least one bearing element of the bearing unit is arranged on the latch element. Preferably, the end of the latch element that faces toward the connecting region executes a travel movement along a distance that, in particular, is greater than 0.5 mm, preferably greater than 1 mm, and particularly preferably greater than 2 mm, in particular in the bearing point, as a result of an actuation.

An "end that can be gripped" is to be understood here to mean, in particular, an end of the latch element, as viewed along the direction of longitudinal extent of the latch element, in particular an end of the operating surface of the latch element, that projects out of the handle housing, in particular along a direction running at least substantially perpendicularly in relation to the direction of longitudinal extent of the latch element, and that can be contacted directly by an operator for the purpose of actuating the latch element. Particularly preferably, the latch element executes a travel movement in the direction of the handle housing as a result of an actuation. In particular, the latch element executes a travel movement in the direction of the handle housing over an at least substantially full longitudinal extent of an operating surface of the latch element. By means of the design of the power tool according to the disclosure, advantageously, the latch element can be operated along an at least substantially full longitudinal extent of the latch element,in particular along an at least substantially full longitudinal extent of an operating surface of the latch element. A high degree of operating comfort can thus be achieved.

Furthermore it is proposed that the bearing unit have at least one bearing element that is arranged at the end of the latch element that faces toward the connecting region of the handle housing. Preferably, the latch element is mounted so as to be movable at least along and/or about a movement axis of the latch element that runs through the bearing element. Particularly preferably, the latch element is mounted so as to be pivotable about the movement axis that runs through the bearing element. The movement axis of the latch element is thus preferably realized as a pivot axis. The pivot axis preferably runs at least substantially perpendicularly in relation to the direction of longitudinal extent of the latch element. The pivot axis in this case preferably runs at least substantially parallelwise in relation to the central plane of the latch element. The design according to the disclosure makes it possible, advantageously, to achieve comfortable operation of the latch element at the end of the latch element that faces away from the connecting region of the handle housing.

Advantageously, the bearing unit has at least one bearing element that is arranged on a side of an actuating region of a switching element of the switching unit that faces toward the connecting region of the handle housing. The switching element is preferably actuated via the latch element. The actuating region is preferably constituted by a switching tappet of the switching element. Particularly advantageously, the mounting of the latch element according to the disclosure makes it possible to use a lever principle, in order to achieve a small switch-on force. Moreover, advantageously, owing to the arrangement of the bearing element according to the disclosure, a large switch-on travel of the latch element can be achieved for actuating the switching element.

It is additionally proposed that the bearing unit have at least one bearing element that is realized as a pin-type bearing element. "Pin-type" is to be understood here to mean, in particular, a geometric design of an element, in particular of the bearing element, wherein the element has a longitudinal extent that is greater than a transverse extent running perpendicularly in relation to the longitudinal extent. Preferably, the bearing element is realized so as to be rotationally symmetrical about at least one axis. Preferably, the axis about which the bearing element is realized so as to be rotationally symmetrical is constituted by the pivot axis of the latch element. It is also conceivable, however, for the bearing element to be of a different design, considered appropriate by persons skilled in the art. Advantageously, the design according to the disclosure makes it possible to achieve a structurally simple bearing element for mounting the latch element.

Particularly preferably, the pin-type bearing element is realized so as to be integral with the handle housing. "Integral with" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. Advantageously, savings can be achieved in components, structural space and costs.

Furthermore, it is proposed that the bearing unit comprise at least one lever mechanism unit. A "lever mechanism unit" is to be understood here to mean, in particular, a unit provided to convert at least one translational movement of an element, in particular of the latch element, as a result of an actuation by an operator, into a rotational movement of the element about at least one axis, wherein the unit preferably has at least one rod-shaped bearing element that is movably arranged on the element to be moved. Preferably, the lever mechanism unit is realized as a coupler mechanism unit. Advantageously, it is possible to achieve exact guidance of the latch element during a movement as a result of an actuation of the latch element.

Particularly preferably, the lever mechanism unit is realized as a parallelogram lever mechanism unit. A "parallelogram lever mechanism unit" is to be understood here to mean, in particular, a unit that keeps at least substantially constant an alignment of the operating surface relative to the handle housing, upon a movement of the latch element, in particular upon a movement about the pivot axis of the latch element, relative to the handle housing. Preferably, bearing elements of the parallelogram lever mechanism unit constitute a parallelogram-type arrangement, in the case of a notional, rectilinear connection of the bearing elements to each other, in particular as viewed in a plane. Thus, advantageously, a uniform travel movement can be achieved, over the entire operating surface of the latch element, in the direction of the handle housing, as a result of an actuation of the latch element. Advantageously, it is thus possible to achieve comfortable operation of the latch element.

It is additionally proposed that the bearing unit comprise at least the lever mechanism unit, which has at least one lever bearing element that actuates an actuating region of a switching element of the switching unit in dependence on a movement of the latch element. Preferably, the lever bearing element is realized as a lever having a respective bearing recess at two ends of the lever bearing element that face away from each other. The lever bearing element is preferably connected, by one end, to a bearing element of the bearing unit that is arranged in the handle housing. The lever bearing element preferably actuates the actuating region, realized as a switching tappet, of the switching element, in dependence on a movement of the latch element, for the purpose of putting the power tool into operation. Advantageously, a saving in components can be realized for the actuation of the switching element, in that the lever bearing element can assume a bearing function and an actuating function.

Advantageously, the bearing unit comprises at least the lever mechanism unit, which has at least one lever bearing element that is movably connected to the latch element, at the end of the latch element that faces toward the connecting region of the handle housing. It is thereby possible to achieve a rotation point arranged outside of the latch element, such that an advantageous lever ratio can be achieved.

Particularly preferably, the lever mechanism unit hasat least one further lever bearing element, which is arranged in a movable manner on the latch element, and in a movable manner on a further bearing element of the bearing unit that is arranged on a side of an actuating region of a switching element of the switching unit that faces toward the connecting region of the handle housing. The arrangement according to the disclosure, and a combined action of the lever bearing element and of the further lever bearing element, enable the parallelogram lever mechanism unit to be realized through simple design means.

Furthermore, it is proposed that the bearing unit have at least one movement guide element, which comprises at least one movement guide path having a course that is different from a pure rectilinear course. A "pure rectilinear course" is to be understood here to mean, in particular, a course of the movement path that is dissociated from bends and/or curves, in particular as viewed along a total extent of the movement guide path.A "course of a movement guide path" is to be understood here to mean, in particular, a course of a path that defines a movement path of the latch element during a movement, wherein the course of the path is constituted by edge regions of the movement guide element that are at least substantially parallel to each other and delimit the path. The movement guide element is preferably arranged on the latch element. Advantageously, owing to the fact that the course of the movement guide path of the movement guide element is different from a pure rectilinear course, the design of the movement guide element according to the disclosure makes it possible to achieve a change of direction of a movement of the latch element, as a result of an actuation of the latch element.

Advantageously, the bearing unit has at least one movement guide element that comprises at least one movement guide path having an L-shaped course. The design according to the disclosure enables a mechanical switch-on inhibitor of the latch element to be achieved through simple design means.

Particularly preferably, the bearing unit has at least one movement guide element that comprises at least one movement guide path having at least one limb that extends at least substantially transversely in relation to a direction of longitudinal extent of the latch element. Preferably, in this case the limb of the movement guide path and the direction of longitudinal extent of the latch element enclose an angle that is greater than 10°, preferably greater than 20°, and particularly preferably greater than 50°. Through simple design means, it is possible to achieve a movement of the latch element, running at least substantially transversely in relation to the direction of longitudinal extent of the latch element, and guided by means of the movement path, as a result of an actuation of the latch element, in order to achieve a travel movement of the latch element along the at least substantially entire extent of the operating surface of the latch element.

It is additionally proposed that the bearing unit have at least one movement guide unit that is provided to act in combination with a bearing element of the bearing unit that engages in a movement guide path of the movement guide element, in order to guide the latch element during a movement. Preferably, the bearing element is realized as a pin-type bearing element.

Preferably, the bearing element is arranged on the inside of the handle housing that faces toward the latch element. Preferably, the bearing element is integrally formed on to the handle housing. It is also conceivable, however, for the bearing element to be realized separately from the handle housing, and to be fixedly connected to the handle housing by means of a type of connection considered appropriate by persons skilled in the art, such as, for example, a form closure and/or force closure type of connection. In addition, however, it is also conceivable for the bearing element to be arranged on the latch element, and for the movement guide element to be arranged on the inside of the handle housing. The design according to the disclosure makes it possible to achieve an inexpensive and structurally simple guidance of the latch element.

Advantageously, the movement guide path of the movement guide element is realized as a guide slot. It is also conceivable, however, for the movement guide path to be of a different design, considered appropriate by persons skilled in the art, such as, for example, a web-type design, a design as a magnetic guide path, etc. A reliable guidance of the latch element during a movement of the latch element can be achieved through simple design means.

Particularly preferably, the movement guide element is realized so as to be integral with the latch element. It is also conceivable, however, for the movement guide element to be realized separately from the latch element, and to be fixedly connected to the latch element by means of a type of connection considered appropriate by persons skilled in the art, such as, for example, a form closure and/or force closure type of connection. Owing to the integral design of the movement guide element and the latch element, savings can be made, advantageously, in components, structural space and costs.

Furthermore, it is proposed that the bearing unit be provided to enable at least one pivot movement, of the further end of the latch element that can be gripped and that faces away from the connecting region, into the handle housing. It is thus possible, advantageously, to achieve comfortable operation of the latch element at the end of the latch element that faces away from the latch element, for the purpose of actuating the switching element.

It is additionally proposed that the switching unit have at least one spring element, which is provided to apply a spring force of the spring element to the latch element, in the direction of an initial position. A "spring element" is to be understood to mean, in particular, a macroscopic element having at least one extent that, in a normal operating state, can be varied elastically by at least 10%, in particular by at least 20%, preferably by at least 30%, and particularly advantageously by at least 50% and that, in particular, generates a counterforce, which is dependent on a variation of the extent and preferably proportional to the variation and which counteracts the variation. An "extent" of an element is to be understood to mean, in particular, a maximum distance of two points of a perpendicular projection of the element on to a plane. A "macroscopic element" is to be understood to mean, in particular, an element having an extent of at least 1 mm, in particular of at least 5 mm, and preferably of at least 10 mm. Preferably, the spring element is constituted by a spring element of the switching element that applies a spring force to a switching tappet of the switching element.

Advantageously, by means of the spring element, a dead man's circuit of the switching unit can be achieved. Thus, advantageously, it is possible to achieve a high degree of safety against the power tool being unintentionally put into operation.

The disclosure is additionally based on a power switching device for a power tool according to the disclosure, wherein the power tool switching device comprises at least the switching unit and at least the bearing unit. Thus, advantageously, already existing power tools can easily be retrofitted with the switching unit and the bearing unit according to the disclosure.

The power tool according to the disclosure and/or the power tool switching device according to the disclosure are/is not intended in this case to be limited to the application and embodiment described above. In particular, the power tool according to the disclosure and/or the power tool switching device according to the disclosure may have individual elements, components and units that differ in number from a number stated herein, in order to fulfill a principle of function described herein.

BRIEF DESCRIPTION OF THE DRAWINGS

Further advantages are given by the following description of the drawings. The drawings show exemplary embodiments of the disclosure. The drawings, the description and the claims contain numerous features in combination. Persons skilled in the art will also expediently consider the features individually and combine them to create appropriate further combinations.

In the drawings.

DETAILED DESCRIPTION

Figure 1:
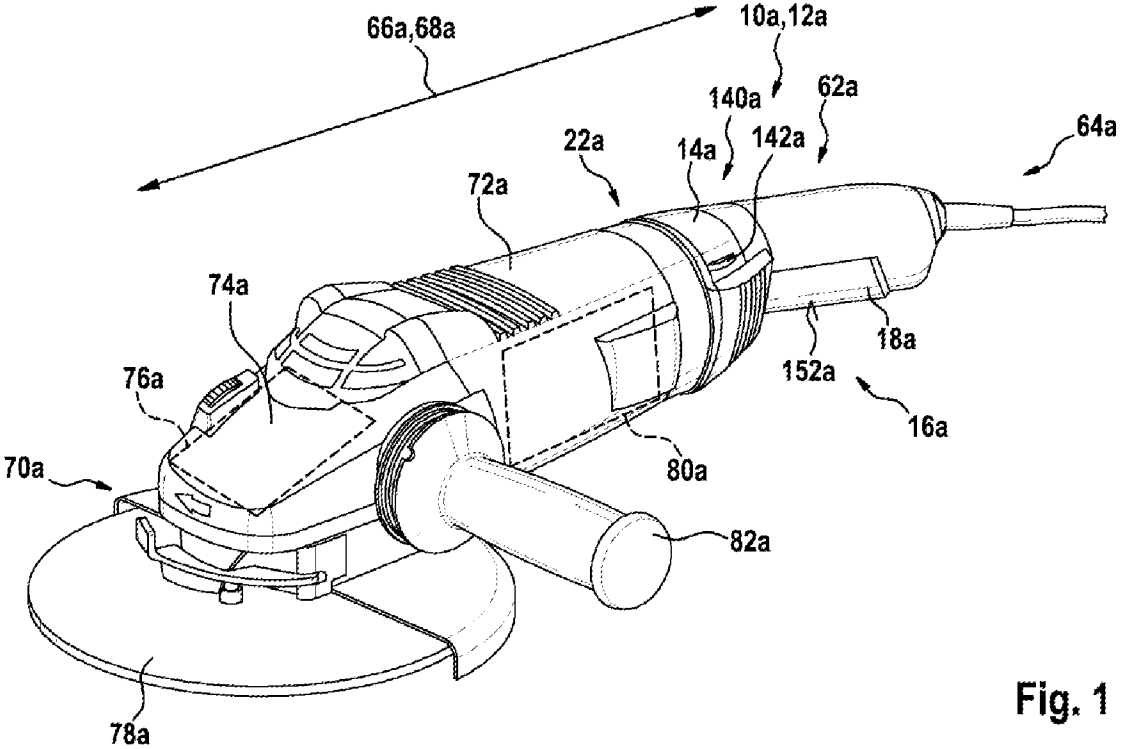
FIG. 1 shows a power tool according to the disclosure, in a schematic representation.

FIG. 1 shows a power tool 10*a*, which is constituted by a portable power tool 10*a* realized as an angle grinder 12*a*. The portable power tool 10*a* comprises at least one handle housing 14*a*, at least one switching unit 16*a*, which has at least one latch element 18*a*, arranged on the handle housing 14*a*, for actuating a switching element 36*a* of the switching unit 16*a*, and at least one bearing unit 20*a*, which is provided to mount the latch element 18*a* so as to be at least movable relative to the handle housing 14*a*. The portable power tool 10*a* in this case has at least one power tool switching device, which comprises at least the switching unit 16*a* and at least the bearing unit 20*a* for mounting the latch element 18*a* of the switching unit 16*a* in a movable manner. The bearing unit 20*a* is provided to ensure a travel movement of the latch element 18*a* along a distance having a value of greater than zero in every case, upon an actuation of the latch element 18*a*, starting from an end 24*a* of the latch element 18*a* that faces toward a connecting region 22*a* of the handle housing 14*a*, in the direction of a further end 26*a* of the latch element 18*a* that can be gripped and that faces away from the connecting region 22*a*. The handle housing 14*a* in this case comprises a stem-type grip region 62*a*, on which the latch element 18*a* is arranged. The stem-type grip region 62*a* of the handle housing 14*a* constitutes a main handle of the portable power tool 10*a*. In this case, the main handle constituted by the stem-type grip region 62*a* extends, at least substantially, starting from a connecting region 22*a* of the main handle housing 14*a*, in a direction away from the connecting region 22*a*, as far as a side 64*a* of the handle housing 14*a* on which there is arranged a cable of the portable power tool 10*a*, realized as an angle grinder 12*a*, for supplying energy. The stem-type grip region 62*a* of the handle housing 14*a* is offset relative to a direction of main extent 66*a* of the handle housing 14*a*, or relative to a direction of main extent 68*a* of the portable power tool 10*a*, by an angle of less than 30°.

The portable power tool 10*a*, realized as an angle grinder 12*a*, additionally comprises a protective cover unit 70*a*, a drive housing 72*a* and an output housing 74*a*. Extending out from the output housing 74*a* there is an output shaft of an output unit 76*a* of the portable power tool 10*a*, which is realized as a spindle (not represented in greater detail here), to which a working tool 78*a* can be fixed, for performing work on a workpiece (not represented in greater detail here). The working tool 78*a* is realized as an abrasive disk. It is also conceivable, however, for the working tool 78*a* to be realized as a parting disk or polishing disk. The portable power tool 10*a* comprises the drive housing 72*a*, for accommodating a drive unit 80*a* of the portable power tool 10*a*, and the output housing 74*a*, for accommodating the output unit 76*a*. The drive unit 80*a* is provided to drive the working tool 78*a* in rotation, via the output unit 76*a*. For the purpose of performing work on a workpiece, the working tool 78*a* in this case may be connected to the spindle in a rotationally fixed manner by means of a fastening element (not represented in greater detail here). The working tool 78*a* can thus be driven in rotation when the portable power tool 10*a* is in operation. The output unit 76*a* is connected to the drive unit 80*a* via a drive element (not represented in greater detail here) of the drive unit 80*a* that is realized as a pinion gear and that can be driven in rotation, in a manner already known to persons skilled in the art. In addition, an ancillary handle 82*a* is arranged on the output housing 74*a*. When mounted on the output housing 74*a*, the ancillary handle 82*a* extends transversely in relation to the direction of main extent 68*a* of the portable power tool 10*a*.

Figure 2:
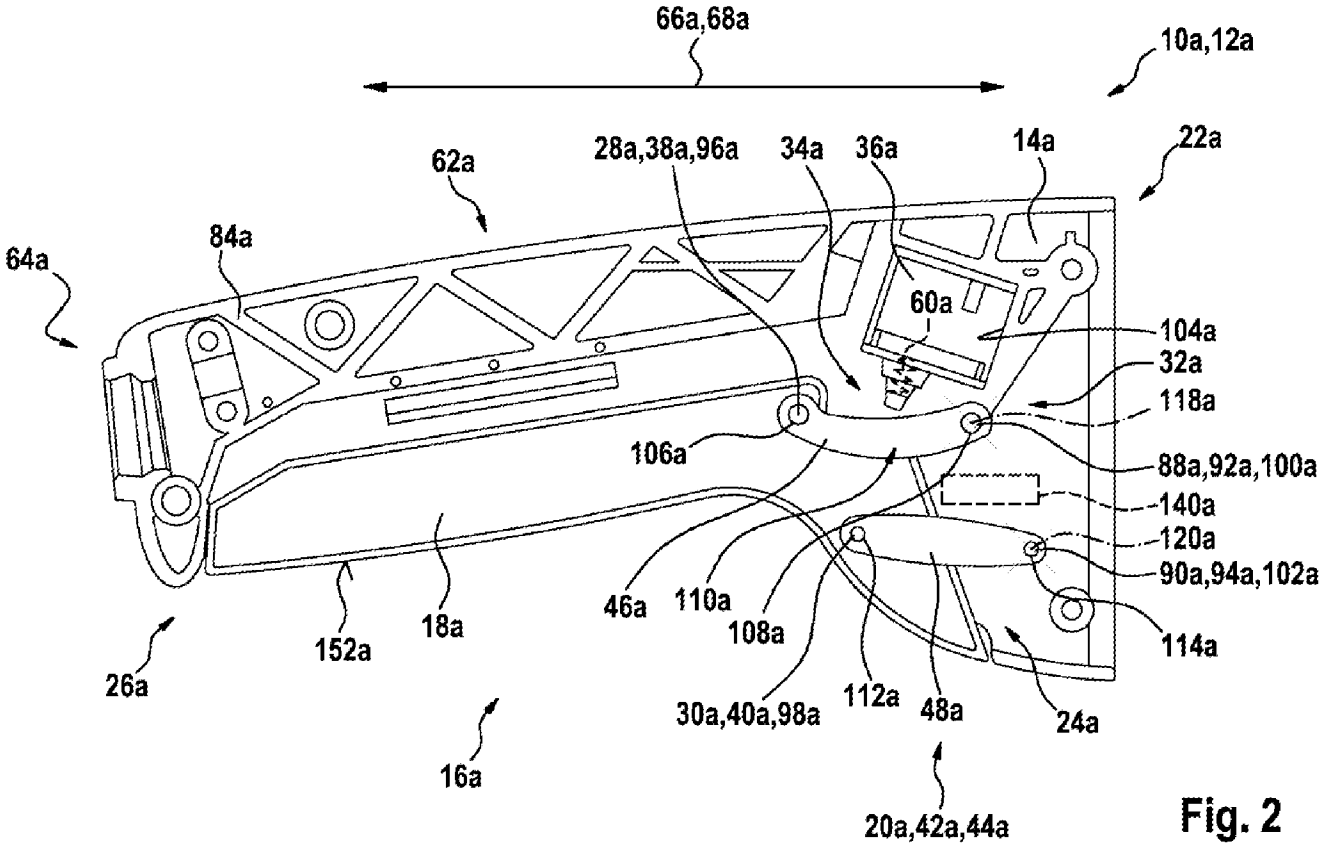
FIG. 2 shows a detail view of a switching unit of the power tool according to the disclosure and of a bearing unit of the power tool according to the disclosure, when mounted in a handle housing of the power tool according to the disclosure, with the switching unit in an unactuated state, in a schematic representation.

FIG. 2 shows a detail view of the switching unit 16*a* and of the bearing unit 20*a* when mounted in the handle housing 14*a*, with the switching unit 16*a* in an unactuated state, wherein one of at least two handle housing shell elements 84*a*, 86*a* of the handle housing 14*a* has been mounted. The bearing unit 20*a* has at least one bearing element 28*a*, which is arranged at the end 24*a* of the latch element 18*a* that faces toward the connecting region 22*a* of the handle housing 14*a*. In addition, the bearing unit 20*a* has at least one further bearing element 30*a*, which is arranged at the end 24*a* of the latch element 18*a* that faces toward the connecting region 22*a* of the handle housing 14*a*. The bearing unit 20*a* thus has at least two bearing elements 28*a*, 30*a*, which are arranged at the end 24*a* of the latch element 18*a* that faces toward the connecting region 22*a* of the handle housing 14*a*. The two bearing elements 28*a*, 30*a* arranged at the end 24*a* of the latch element 18*a* that faces toward the connecting region 22*a* are thus realized as latch bearing elements 96*a*, 98*a*. Furthermore, the bearing unit 20*a* has at least one bearing element 88*a*, which is arranged on a side 32*a* of an actuating region 34*a* of the switching element 36*a* of the switching unit 16*a* that faces toward the connecting region 22*a* of the handle housing 14*a*. In total, the bearing unit 20*a* has at least two bearing elements 88*a*, 90*a*, which are arranged on a side 32*a* of an actuating region 34*a* of the switching element 36*a* of the switching unit 16*a* that faces toward the connecting region 22*a* of the handle housing 14*a*. The switching element 36*a* is fixedly arranged in a receiving recess 104*a* of at least one of the handle housing shell elements 84*a*, 86*a*. The receiving recess 104*a* in this case, starting from the latch element 18*a*, as viewed along the direction of main extent 66*a* of the handle housing 14*a* in the direction of the connecting region 22*a*, is arranged, at least partially, after the latch element 18*a*, in the handle housing 14*a*.

In this case, the two bearing elements 88*a*, 90*a* arranged on the side 32*a* of the actuating region 34*a* of the switching element 36*a* that faces toward the connecting region 22*a* of the handle housing 14*a*, starting from the latch element 18*a*, as viewed along the direction of main extent 66*a* of the handle housing 14*a* in the direction of the connecting region 22*a*, are arranged after the latch element 18*a*, in the handle housing 14*a*, in at least one operating state of the latch element 18*a*. The two bearing elements 88*a*, 90*a* arranged on the side 32*a* of the actuating region 34*a* of the switching element 36*a* that faces toward the connecting region 22*a* of the handle housing 14*a* are thus realized as handle housing bearing elements 100*a*, 102*a*. The bearing elements 28*a*, 30*a*, realized as latch bearing elements 96*a*, 98*a*, and the bearing elements 88*a*, 90*a*, realized as handle housing bearing elements 100*a*, 102*a*, are each realized as pin-type bearing elements 38*a*, 40*a*, 92*a*, 94*a*. In this case, the pin-type bearing elements 38*a*, 40*a* that are realized as latch bearing elements 96*a*, 98*a* are realized so as to be integral with the latch element 18*a*. In addition, the pin-type bearing elements 92*a*, 94*a* that are realized as handle housing bearing elements 100*a*, 102*a* are realized so as to be integral with the handle housing 14*a*. It is also conceivable, however, for the pin-type bearing elements 38*a*, 40*a*, realized as latch bearing elements 96*a*, 98*a*, and the pin-type bearing elements 92*a*, 94*a*, realized as handle housing bearing elements 100*a*, 102*a*, to be realized separately from the latch element 18*a*, or separately from the handle housing 14*a*, respectively, and for each to be fixedly connected to the latch element 18*a*, or to the handle housing 14*a*, respectively, by means of a type of connection considered appropriate by persons skilled in the art, such as, for example, a form closure and/or force closure type of connection.

Figure 3:
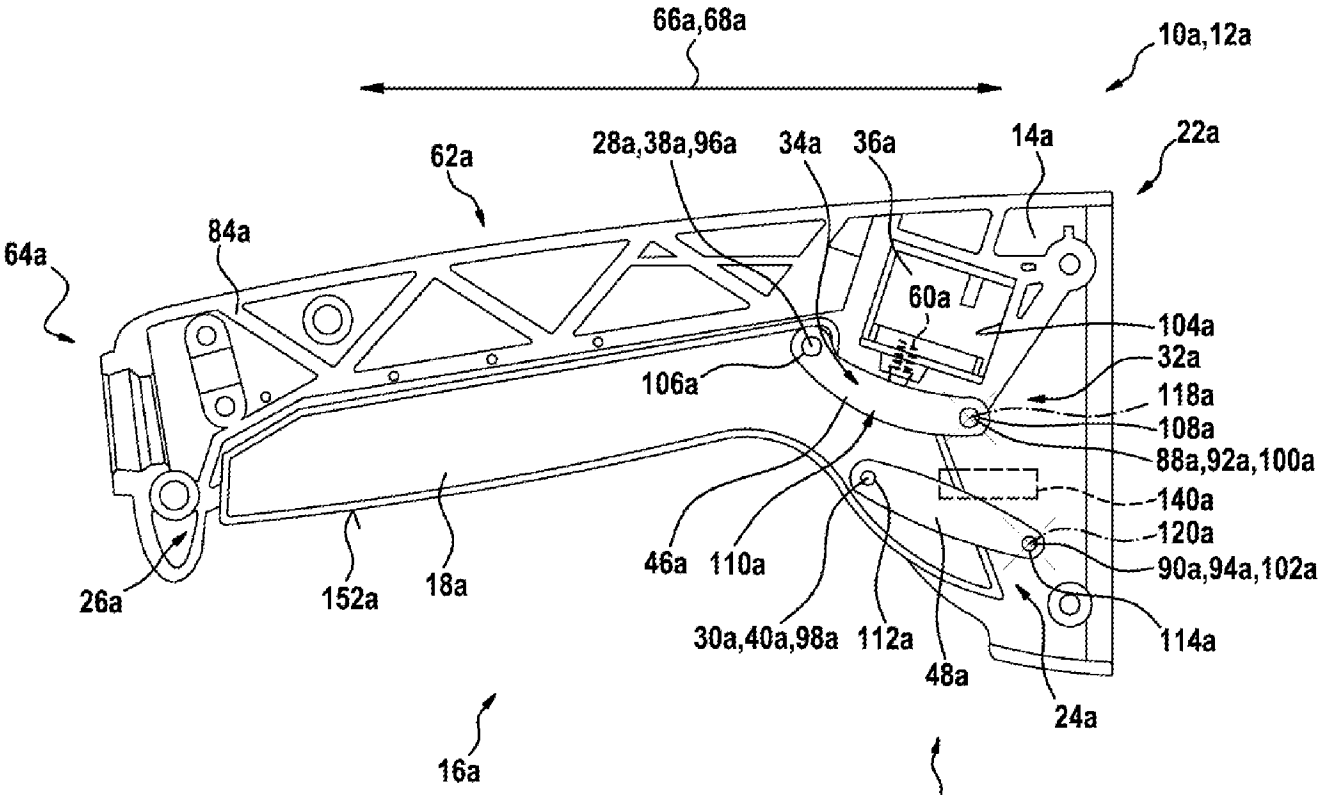
FIG. 3 shows a detail view of the switching unit and of the bearing unit from FIG. 2, when mounted in the handle housing, with the switching unit in an actuated state, in a schematic representation.

Furthermore, the bearing unit 20*a* comprises at least one lever mechanism unit 42*a*. The lever mechanism unit 42*a* in this case is realized as a parallelogram lever mechanism unit 44*a*. It is also conceivable, however, for the lever mechanism unit 42*a* to be of a different design, such as, for example, a design as a three-hinge coupler mechanism, as a five-hinge coupler mechanism, etc. The lever mechanism unit 42*a* has at least one lever bearing element 46*a*, which actuates an actuating region 34*a* of the switching element 36*a* of the switching unit 16*a* in dependence on a movement of the latch element 18*a* (FIG. 3). The lever bearing element 46*a* is movably connected to the latch element 18*a* at the end 24*a* of the latch element 18*a* that faces toward the connecting region 22*a* of the handle housing 14*a*. In this case, the lever bearing element 46*a*, which is realized as a lever, has at least two bearing recesses 106*a*, 108*a*, arranged at ends of the lever bearing element 46*a* that face away from each other. One of the two bearing recesses 106*a*, 108*a* is movably connected to one of the two latch bearing elements 96*a*, 98*a*. In addition, one of the two bearing recesses 106*a*, 108*a* is movably connected to one of the two handle housing bearing elements 100*a*, 102*a*. Moreover, the lever bearing element 46*a* is of a curved design in a sub-region 110*a* between the bearing recesses 106*a*, 108*a*. It is also conceivable, however, for the lever bearing element 46*a*, in the sub-region 110*a*, to be of a different design, considered appropriate by persons skilled in the art, such as, for example, a ridge-type projection, etc. The sub-region 110*a* is provided to actuate the actuating region 34*a* of the switching element 36*a* of the switching unit 16*a* in dependence on a movement of the latch element 18*a*.

In addition, the lever mechanism unit 42*a*, realized as a parallelogram lever mechanism unit 44*a*, has at least one further lever bearing element 48*a*, which is arranged in a movable manner on the latch element 18*a*, and in a movable manner on the further bearing element 30*a*, realized as a handle housing bearing element 100*a*, of the bearing unit 20*a* that is arranged on the side 32*a* of the actuating region 34*a* of the switching element 36*a* of the switching unit 16*a* that faces toward the connecting region 22*a* of the handle housing 14*a*. In this case, the further lever bearing element 48*a*, which is realized as a lever, has at least two bearing recesses 112*a*, 114*a*, arranged at ends of the lever bearing element 48*a* that face away from each other. One of the two bearing recesses 112*a*, 114*a* is movably connected to one of the two latch bearing elements 96*a*, 98*a*. In addition, one of the two bearing recesses 112*a*, 114*a* is movably connected to one of the two handle housing bearing elements 100*a*, 102*a*. The lever bearing element 46*a* and the further lever bearing element 48*a* are aligned at least substantially parallelwise in relation to each other, in respect of a rectilinear, notional connecting line of the bearing recesses 106*a*, 108*a* of the lever bearing element 46*a* and in respect of a rectilinear, notional connecting line of the bearing recesses 112*a*, 114*a* of the further lever bearing element 48*a*. Owing to the at least substantially parallel arrangement of the lever bearing element 46*a* and lever bearing element 48*a*, a parallel guidance of the latch element 18*a* is realized, as a result of an actuation of the latch element 18*a*. In this case, the further end 26*a* of the latch element 18*a* that can be gripped and that faces away from the connecting region 22*a* is dissociated from an arrangement of bearing points of the bearing unit 20*a*.

By means of the bearing unit 20*a* realized as a lever mechanism unit 42*a*, a lever ratio that is greater than 1 to 2.7 is achieved between the actuating region 34*a* of the switching element 36*a* and the latch element 18*a*. The lever ratio corresponds to a length of a distance, measured from the longitudinal axis of the handle housing bearing element 100*a*, which is connected to one of the bearing recesses 106*a*, 108*a* of the lever bearing element 46*a*, as far as a central axis of the actuating region 34*a* of the switching element 36*a* that is realized as a switching tappet, in relation to a length of a distance, measured from the longitudinal axis of the handle housing bearing element 100*a*, which is connected to one of the bearing recesses 106*a*, 108*a* of the lever bearing element 46*a*, as far as a longitudinal axis of the latch bearing element 96*a*, which is connected to one of the bearing recesses 106*a*, 108*a* of the lever bearing element 46*a*.

Furthermore, the switching unit 16*a* has at least one spring element 60*a*, which is provided to apply a spring force of the spring element 60*a* to the latch element 18*a*, in the direction of an initial position of the latch element 18*a*. The spring element 60*a* is provided to constitute a dead man's circuit function of the switching unit 16*a*. The spring element 60*a* is provided to enable the latch element 18*a* to move into an initial position of the latch element 18*a*, as a result of an action of a spring force upon the latch element 18*a*, after removal of an action of an actuating force of an operator upon the latch element 18*a*, in a direction away from the handle housing 14*a*. The spring element 60*a* in this case is constituted by a spring element of the switching element 36*a* that applies a spring force to the actuating region 34*a*, realized as a switching tappet, of the switching element 36*a*. The spring element 60*a* thus exerts a spring force upon the latch element 18*a* via the lever bearing element 46*a*, which actuates the actuating region 34*a*, realized as a switching tappet, of the switching element 36*a* as a result of a movement of the latch element 18*a* in the direction of the handle housing 14*a*. As a result of this, the latch element 18*a*, after removal of an action of an actuating force of an operator, is moved in the direction away from the handle housing 14*a*. It is also conceivable, however, for the switching unit 16*a*, in addition to or as an alternative to having the spring element 60*a*, to have a further spring element, which is supported on the latch element 18*a* and on the handle housing 14*a*, and which is provided to apply a spring force to the latch element 18*a* in the direction of an initial position of the latch element 18*a*.

The latch element 18*a* is mounted so as to be pivotable about pivot axes 118*a*, 120*a*, which go through the handle housing bearing elements 100*a*, 102*a*. The pivot axes 118*a*, 120*a* in this case constitute longitudinal axes of the handle housing bearing elements 100*a*, 102*a*, about which the handle housing bearing elements 100*a*, 102*a* are rotationally symmetrical. An alignment of an operating surface 152*a* of the latch element 18*a* relative to the handle housing 14*a* is maintained, at least substantially, by means of the bearing unit 20*a*, upon a movement of the latch element 18*a* relative to the handle housing 14*a*. By means of the bearing unit 20*a*, therefore, an even travel movement is achieved over then entire operating surface 152*a* of the latch element 18*a*, in the direction of the handle housing 14*a*, as a result of an actuation of the latch element 18*a*.

Figure 4:
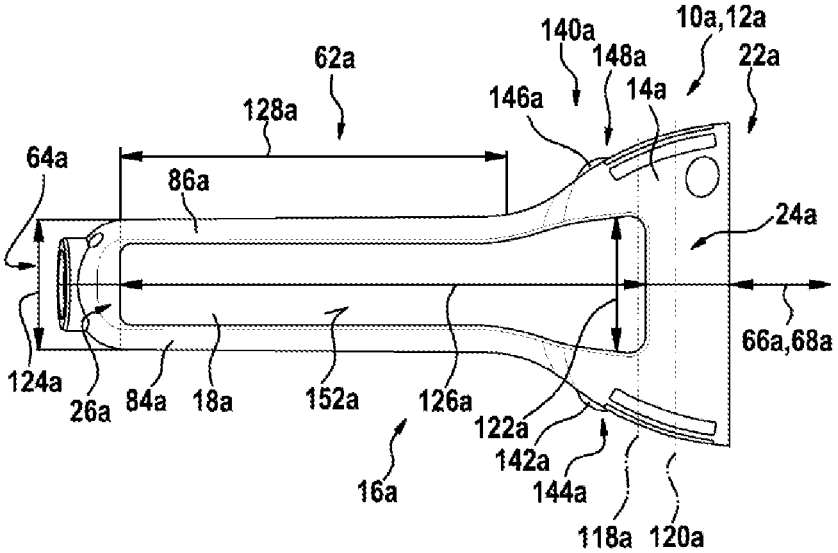
FIG. 4 shows a detail view of a latch element of the switching unit arranged on the handle housing, in a schematic representation.

FIG. 4 shows a detail view of the latch element 18*a* of the switching unit 16*a* arranged on the handle housing 14*a*. The latch element 18*a* is mounted on the handle housing 14*a* so as to be pivotable about the pivot axes 118*a*, 120*a* of the latch element 18*a*. The pivot axes 118*a*, 120*a* of the latch element 18*a* run at least substantially perpendicularly in relation to the direction of main extent 66*a* of the handle housing 14*a*, or at least substantially perpendicularly in relation to the direction of main extent 68*a* of the portable power tool 10*a*. In this case, the pivot axes 118*a*, 120*a* run at least substantially perpendicularly in relation to a joint plane of the handle housing 14*a*. When in a mounted state, the two handle housing shell elements 84*a*, 86*a* of the handle housing 14*a* are joined together in the joint plane of the handle housing 14*a*. The pivot axes 118*a*, 120*a* are arranged at the end 24*a* of the latch element 18*a* that faces toward the connecting region 22*a* of the handle housing 14*a*. The latch element 18*a* is thus pivotally mounted at the end 24*a* that faces toward the connecting region 22*a* of the handle housing 14*a*.

The latch element 18*a* has a maximum transverse extent 122*a* that extends at least over a major part of at least a maximum transverse extent 124*a* of the stem-type grip region 62*a* of the handle housing 14*a*. In this case, the ratio of the maximum transverse extent 122*a* of the latch element 18*a* to the maximum transverse extent 124*a* of the stem-type grip region 62*a* of the handle housing 14*a* is at least greater than 1 to 2.5. The maximum transverse extent 122*a* of the latch element 18*a* runs along a direction that runs at least substantially perpendicularly in relation to the direction of main extent 66*a* of the handle housing 14*a*, or at least substantially perpendicularly in relation to the direction of main extent 68*a* of the portable power tool 10*a*, and at least substantially transversely at least in relation to a main direction of movement of the latch element 18*a*. The maximum transverse extent 122*a* of the latch element 18*a* thus runs at least substantially parallelwise in relation to the pivot axes 118*a*, 120*a* of the latch element 18*a*. The maximum transverse extent 124*a* of the stem-type grip region 62*a* of the handle housing 14*a* likewise runs along the direction that runs at least substantially perpendicularly in relation to the direction of main extent 66*a* of the handle housing 14*a*, or at least substantially perpendicularly in relation to the direction of main extent 68*a* of the portable power tool 10*a*, and at least substantially transversely at least in relation to a main direction of movement of the latch element 18*a*.

Furthermore, the latch element 18*a* has a maximum longitudinal extent 126*a* that extends at least over a major part of a maximum longitudinal extent 128*a* of the stem-type grip region 62*a* of the handle housing 14*a*. A ratio of the maximum longitudinal extent 126*a* of the latch element 18*a* to the maximum longitudinal extent 128*a* of the stem-type grip region 62*a* of the handle housing 14*a* is at least greater than 1 to 1.4. When the latch element 18*a* has been mounted on the handle housing 14*a*, the maximum longitudinal extent 126*a* of the latch element 18*a* extends along a direction that runs in the joint plane of the handle housing 14*a*, and that runs at least substantially transversely in relation to a main direction of movement of the latch element 18*a*. The maximum longitudinal extent 126*a* of the latch element 18*a* thus extends along a direction that runs at least substantially perpendicularly in relation to the pivot axes 118*a*, 120*a* of the latch element 18*a*. The maximum longitudinal extent 128*a* of the stem-type grip region 62*a* of the handle housing 14*a* likewise extends along the direction that runs at least substantially perpendicularly in relation to the pivot axes 118*a*, 120*a* of the latch element 18*a*.

Figure 5:
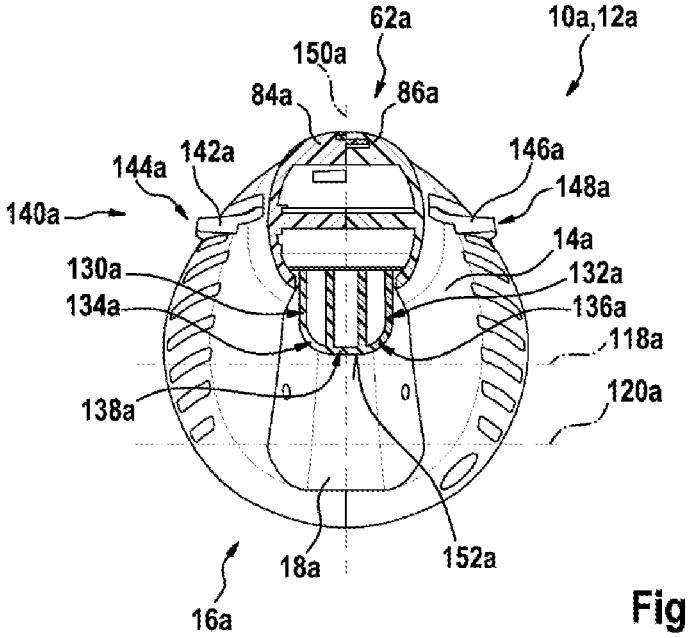
FIG. 5 shows a further detail view of the latch element arranged on the handle housing, in a schematic representation.

In addition, the latch element 18*a* has at least one side wall region 130*a*, which is connected, via a bow-shaped sub region 134*a* of the latch element 18*a*, to a grip surface region 138*a* of the latch element 18*a* that runs at least substantially perpendicularly in relation to the side wall region 130*a*, wherein a ratio of a radius of the bow-shaped sub region 134*a* to the maximum transverse extent 124*a* of the stem-type grip region 62*a* of the handle housing 14*a* is at least greater than 1 to 8 (FIG. 5). In total, the latch element 18*a* has two side wall regions 130*a*, 132*a*, each of which is respectively connected, via one of the two bow-shaped sub-regions 134*a*, 136*a* of the latch element 18*a*, to the grip surface region 138*a* of the latch element 18*a* that runs at least substantially perpendicularly in relation to the side wall regions 130*a*, 132*a*.

The grip surface region 138*a* of the latch element 18*a*, as viewed along the direction of main extent 66*a* of the handle housing 14*a*, extends at least over a major part of the maximum longitudinal extent 126*a* of the latch element 18*a*. Moreover, the grip surface region 138*a* of the latch element 18*a*, as viewed along the direction of main extent 66*a* of the handle housing 14*a*, has an at least substantially flat course. Thus, the course of the grip surface region 138*a* of the latch element 18*a* is to a large extent dissociated from step-type offsets. It is also conceivable, however, for the grip surface region 138*a* of the latch element 18*a* to have at least one finger recess region, which is provided to receive at least one finger of a hand of an operator when the latch element 18*a* is being operated, or held.

Furthermore, the portable power tool 10*a* has at least one switch-on inhibitor unit 140*a*, which is provided to avoid, at least to a large extent, a movement of the latch element 18*a* as a result of an unintentional actuation of the latch element 18*a* (FIG. 1). The switch-on inhibitor unit 140*a* is realized as a mechanical inhibitor unit. It is also conceivable, however, for the switch-on inhibitor unit 140*a* to be realized as an electrical and/or electronic inhibitor unit. The switch-on inhibitor unit 140*a* has at least one release element 142*a*, which comprises an actuating region 144*a* that is arranged, at least partially, laterally next to one of the side wall regions 130*a*, 132*a* of the latch element 18*a* (FIG. 5). Moreover, the switch-on inhibitor unit 140*a* has at least one further release element 146*a*, which has an actuating region 148*a* that is arranged, at least partially, laterally next to one of the side wall regions 130*a*, 132*a* of the latch element 18*a* (FIG. 5). One of the side wall regions 130*a*, 132*a* faces toward the release element 142*a*, and one of the side wall regions 130*a*, 132*a* faces toward the further release element 146*a*.

In this case, the actuating regions 144*a*, 148*a* of the release element 142*a* and of the further release element 146*a* are arranged at a distance from the respective side wall region 130*a*, 132*a*, in each case as viewed, starting from the joint plane of the handle housing 14*a*, in a direction running at least substantially perpendicularly in relation to the joint plane of the handle housing 14*a* and away from the handle housing 14*a*. The release element 142*a* and the further release element 146*a* are arranged in a mirror-symmetrical manner in respect of the joint plane of the handle housing 14*a*. In addition, the release element 142*a* and the further release element 146*a* are mounted so as to be pivotable about a release pivot axis 150*a*. The release pivot axis 150*a* in this case runs in the joint plane of the handle housing 14*a*. In addition, the release pivot axis 150*a* runs at least substantially perpendicularly in relation to the pivot axes 118*a*, 120*a* of the latch element 18*a*.

In an alternative design of the portable power tool 10*a*, which is not represented in greater detail here, it is conceivable for the portable power tool 10*a*, in addition to having the switch-on inhibitor unit 140*a*, to have an electrical and/or electronic start-up inhibitor, which, for example, only allows the drive unit 80*a* to be supplied with electric power once a sensor unit of the portable power tool 10*a* senses a further hand of an operator having been placed on the ancillary handle 82*a*, in addition to a hand having been placed on the handle housing 14*a*, in particular on the stem-type grip region 62*a*, and thus deactivates the electrical and/or electronic start-up inhibitor, via an open-loop and/or closed-loop control unit of the portable power tool 10*a*, which evaluates and processes the characteristic quantities sensed by the sensor unit, to enable the portable power tool 10*a* to be put into operation.

An alternative exemplary embodiment is represented in FIGS. 6 to 8*c*. Components, features and functions that remain substantially the same are denoted, in principle, by the same references. To differentiate the exemplary embodiments, the letters a and b have been appended to the references of the exemplary embodiments. The description that follows is limited substantially to the differences in relation to the first exemplary embodiment in FIGS. 1 to 5, and reference may be made to the description of the first exemplary embodiment in FIGS. 1 to 5 in respect of components, features and functions that remain the same.

Figure 6:
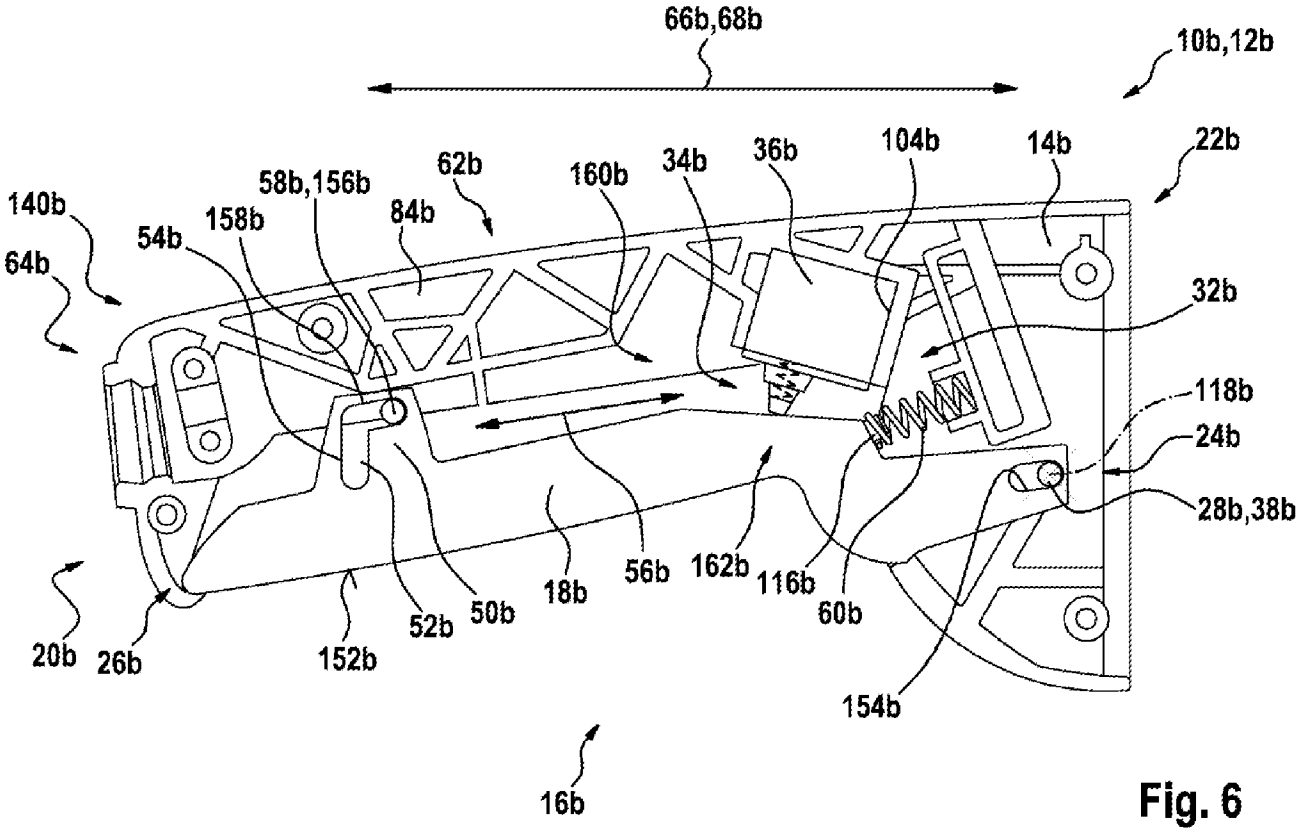
FIG. 6 shows a detail view of a switching unit of an alternative power tool according to the disclosure and of a bearing unit of the alternative power tool according to the disclosure, when mounted in a handle housing of the alternative power tool according to the disclosure, with the switching unit in an unactuated state, in a schematic representation.

FIG. 6 shows a detail view of a switching unit 16*b* of a power tool 10*b* that is realized as an alternative to the power tool 10*a* from FIG. 1, and of a bearing unit 20*b* of the power tool 10*b*, when mounted in a main handle housing 14*b* of the power tool 10*b*, with the switching unit 16*b* in an unactuated state, wherein one of at least two handle housing shell elements 84*b*, 86*b* of the handle housing 14*b* has been removed. The power tool 10*b* has a structure that is at least substantially similar to that of the power tool 10*a* from FIG. 1. Reference may therefore be made, at least substantially, to the description of FIG. 1 in respect of a description, or features, of the power tool 10*b* of the further exemplary embodiment. The power tool 10*b* is likewise realized as a portable power tool 10*b*, which is constituted by an angle grinder 12*b*. The power tool 10*b* comprises at least the handle housing 14*b*, at least the switching unit 16*b*, which has at least one latch element 18*b*, arranged on the handle housing 14*b*, for actuating a switching element 36*b* of the switching unit 16*b*, and at least the bearing unit 20*b*, which is provided for mounting the latch element 18*b* so as to be at least movable relative to the handle housing 14*b*.

The bearing unit 20*b* is provided to ensure a travel movement of the latch element 18*b* along a distance having a value of greater than zero in every case, upon an actuation of the latch element 18*b*, starting from an end 24*b* of the latch element 18*b* that faces toward a connecting region 22*b* of the handle housing 14*b*, in the direction of a further end 26*b* of the latch element 18*b* that can be gripped and that faces away from the connecting region 22*b*. The bearing unit 20*b* is additionally provided to enable at least one pivot movement of the further end 26*b* of the latch element 18*b* that can be gripped and that faces away from the connecting region 22*b* into the handle housing 14*b*, as a result of an actuation of the latch element 18*b*. The bearing unit 20*b* in this case has at least one bearing element 28*b*, which is arranged at the end 24*b* of the latch element 18*b* that faces toward the connecting region 22*b* of the handle housing 14*b*. The bearing element 28*b* is additionally arranged on a side 32*b* of an actuating region 34*b* of the switching element 36*b* of the switching unit 16*b* that faces toward the connecting region 22*b* of the handle housing 14*b*. The actuating region 34*b* of the switching element 36*b* is constituted by a switching tappet of the switching element 36*b*. The bearing element 28*b* is realized as a pin-type bearing element 38*b*. In this case, the pin-type bearing element 28*b* is realized so as to be integral with the handle housing 14*b*. The bearing element 28*b*, realized as a pin-type bearing element 38*b*, is realized so as to be integral with one of the handle housing shell elements 84*b*, 86*b* of the handle housing 14*b*. In this case, a longitudinal axis of the bearing element 28*b* that runs at least substantially perpendicularly in relation to the direction of longitudinal extent 56*b* of the latch element 18*b* constitutes a pivot axis 118*b* of the latch element 18*b*. The bearing element 28*b* is realized so as to be rotationally symmetrical about the longitudinal axis of the bearing element 28*b*.

The latch element 18*b* has a bearing recess 154*b*, for receiving the bearing element 38*b*, realized as a pin-type bearing element 38*b*. The bearing recess 154*b* is arranged at the end 24*b* of the latch element 18*b* that faces toward the connecting region 22*b*. The bearing recess 154*b* in this case is realized as an oblong hole, in which the bearing element 28*b* engages when the latch element 18*b* has been mounted on the handle housing 14*b*.It is also conceivable, however, for the bearing recess 154*b* to be of a different design, considered appropriate by persons skilled in the art, such as, for example, designed as a web-type guide element, etc. The bearing recess 154*b*, realized as an oblong hole, runs at least substantially parallelwise in relation to a direction of longitudinal extent 56*b* of the latch element 18*b*. The bearing recess 154*b*, as viewed along the direction of longitudinal extent 56*b*, has a maximum longitudinal extent that is at least twice as great as a maximum extent of the bearing element 28*b* along the direction of longitudinal extent 56*b*. Thus, by means of a combined action of the bearing element 28*b* and the bearing recess 154*b*, displaceability of the latch element 18*b* along the direction of longitudinal extent 56*b* can be achieved.

Furthermore, the bearing unit 20*b* has at least one movement guide element 50*b*, which comprises at least one movement guide path 52*b* having a course that is different from a pure rectilinear course. The movement guide path 52*b* in this case has an L-shaped course.

The movement guide path 52*b* thus has at least one limb 54*b*, which extends at least substantially transversely in relation to the direction of longitudinal extent 56*b* of the latch element 18*b*. In addition, the movement guide path 52*b* of the movement guide element 50*b* has a further limb 158*b*, which extends at least substantially parallelwise in relation to the direction of longitudinal extent 56*b* of the latch element 18*b*. The movement guide element 50*b* is provided to act in combination with a further bearing element 58*b* of the bearing unit 20*b* that engages in the movement guide element 50*b*, for the purpose of guiding the latch element 18*b* during a movement. The movement guide path 52*b* of the movement guide element 50*b* is realized as a guide slot. In this case, the guide slot is constituted by an L-shaped oblong hole.

The movement guide element 50*b* is realized so as to be integral with the latch element 18*b*. In this case, the movement guide element 50*b* is arranged at the end 26*b* of the latch element 18*b* that faces away from the connecting region 22*b*. The further bearing element 58*b* of the bearing unit 20*b*, which acts in combination with the movement guide element 50*b* when the latch element 18*b* has been mounted on the handle housing 14*b*, is likewise realized as a pin-type bearing element 156*b*. In this case, the further bearing element 58*b*, realized as a pin-type bearing element 156*b*, is realized so as to be integral with one of the handle housing shell elements 84*b*, 86*b* of the handle housing 14*b*. In addition, the further bearing element 58*b* is arranged on a side 160*b* of the actuating region 34*b* of the switching element 36*b* that faces away from the connecting region 22*b*. The switching element 36*b* is fixedly arranged in a receiving recess 104*b* of at least one of the handle housing shell elements 84*b*, 86*b*. The latch element 18*b* has a switching region 162*b*, for actuating the actuating region 34*b*, realized as a switching tappet, of the switching element 36*b*. The switching region 162*b*, as viewed along the direction of longitudinal extent 56*b* of the latch element 18*b*, is constituted by a region of the latch element 18*b* that is arranged between the movement guide element 50*b* and the bearing recess 154*b*, and that faces toward the handle housing 14*b* when the latch element 18*b* has been mounted on the handle housing 14*b*.

In addition, the switching unit 16*b* has at least one spring element 60*b*, which is provided to apply a spring force of the spring element 60*b* to the latch element 18*b*, in the direction of an initial position. The spring element 60*a* is provided to constitute a dead man's circuit function of the switching unit 16*a*. The spring element 60*b* is realized as a compression spring. It is also conceivable, however, for the spring element 60*b* to be of another design, considered appropriate by persons skilled in the art, such as, for example, designed as a tension spring, etc. In this case, the spring element 60*b* is supported, by one end, on at least one of the handle housing shell elements 84*b*, 86*b* of the handle housing 14*b*. By a further end, the spring element 60*b* is supported on the latch element 18*b*. The latch element 18*b* has a pin-type guide stud 116*b* for guiding the spring element 60*b*. The guide stud 116*b* is arranged at the end 24*b* of the latch element 18*b* that faces toward the connecting region 22*b*. A longitudinal axis of the spring element 60*b* runs at least substantially transversely in relation to the direction of longitudinal extent 56*b* of the latch element 18*b*, at least when the latch element 18*b* is in an initial position, in which the latch element 18*b* is unactuated.

For the purpose of putting the portable power tool 10*b* into operation, the latch element 18*b* is moved by an operator, starting from an initial position of the latch element 18*b* (FIG. 8*a*), along the direction of longitudinal extent 56*b* of the latch element 18*b*, in the direction of the connecting region 22*b* of the handle housing 14*b*. As a result of this, a switch-on inhibitor unit 140*b* of the portable power tool 10*b* is deactivated. The switch-on inhibitor unit 140*b* is constituted by a combined action of the further limb 158*b* of the movement guide path 52*b* of the movement guide element 50*b* and of the further bearing element 58*b*. The combined action of the further limb 158*b* of the movement guide path 52*b*, when the latch element 18*b* is in the initial position, prevents, at least to a large extent, a movement of the latch element 18*b* in a direction running at least substantially transversely in relation to the direction of longitudinal extent 56*b* of the latch element 18*b* and running in the direction of the handle housing 14*b*.

As a result of a movement of the latch element 18*b* along the direction of longitudinal extent 56*b* of the latch element 18*b*, the bearing recess 154*b* is moved relative to the bearing element 28*b*, until the bearing element 28*b* strikes against, or bears against, an edge region of the latch element 18*b* that delimits the bearing recess 154*b* and that is arranged on a side of the bearing recess 154*b* facing away from the connecting region 22*b*. After an operator has moved the latch element 18*b* along the direction of longitudinal extent 56*b* of the latch element 18*b* (FIG. 8*b*), the further bearing element 58*b* and the limb 54*b* of the movement guide path 52*b* of the movement guide element 50*b*, which limb extends at least substantially transversely in relation to the direction of longitudinal extent 56*b* of the latch element 18*b*, are in alignment (FIG. 7).

Figure 7:
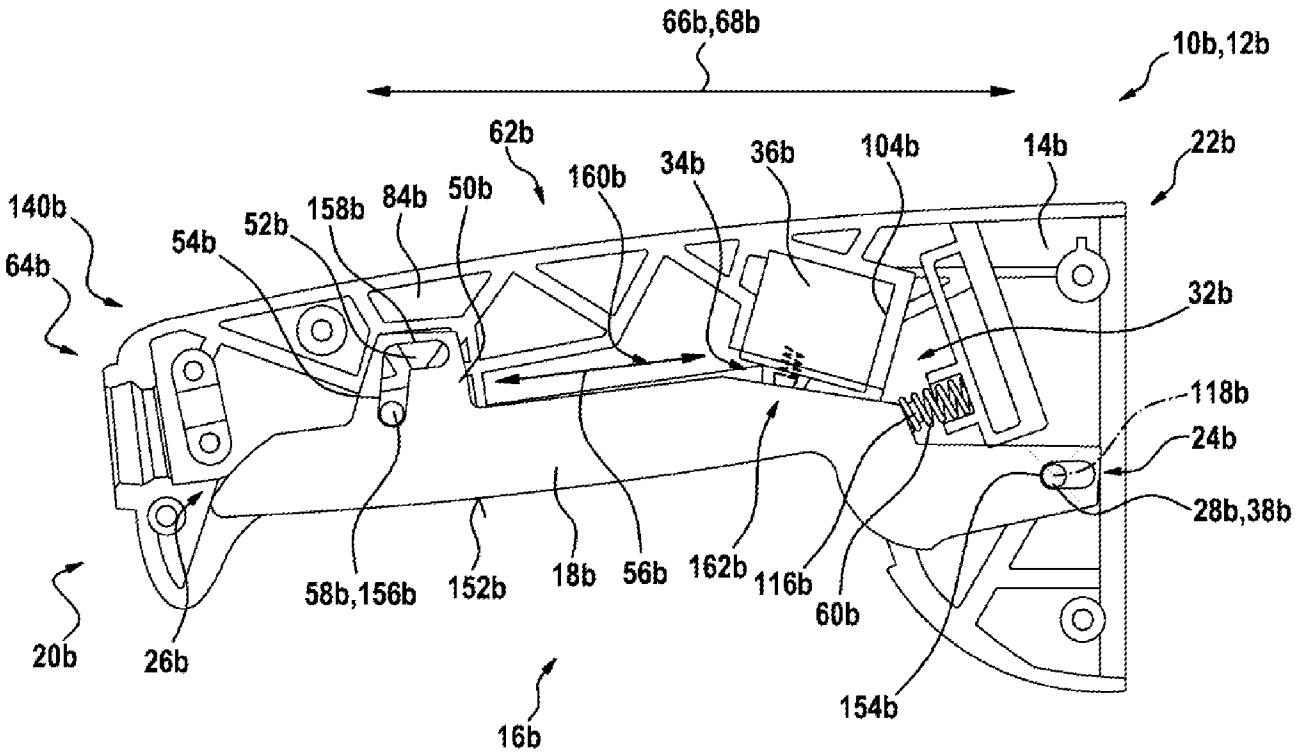
FIG. 7 shows a detail view of the switching unit and of the bearing unit from FIG. 5, when mounted in the handle housing, with the switching unit in an actuated state, in a schematic representation.
Figure 8A:
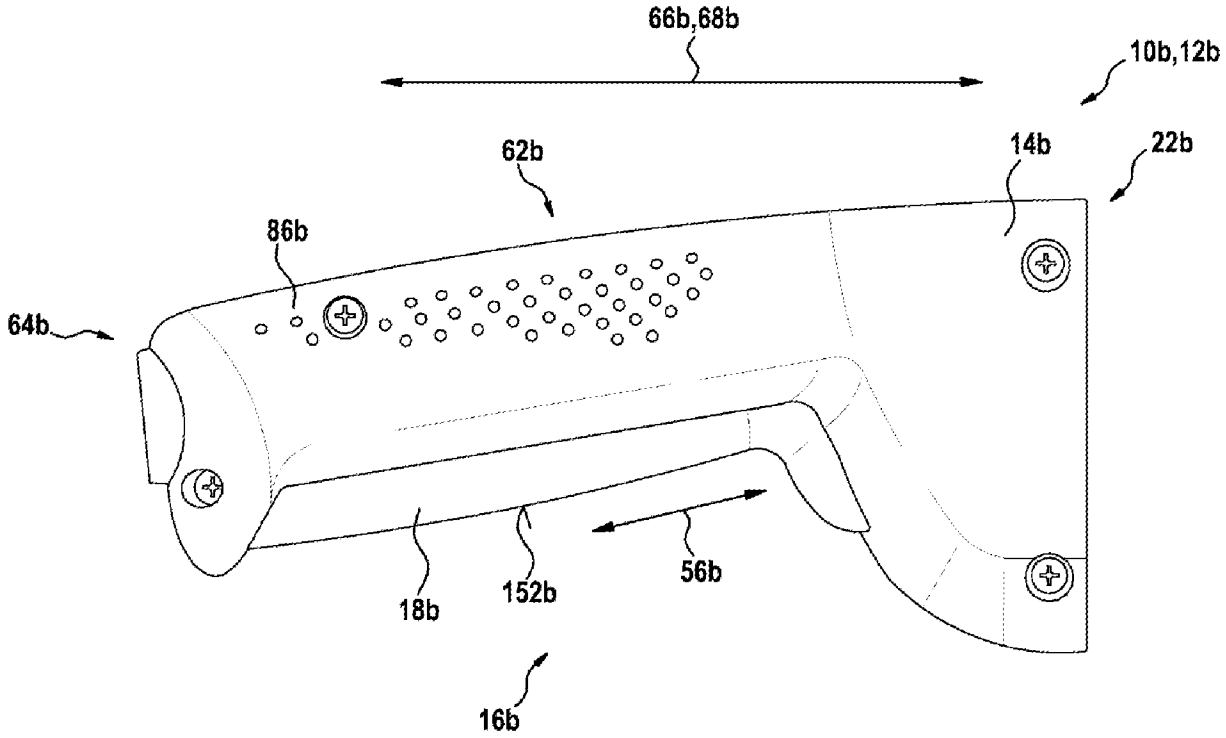
FIG. 8*a* shows a detail view of a latch element of the switching unit from FIG. 5 arranged on the handle housing, in an unactuated state, in a schematic representation.
Figure 8B:
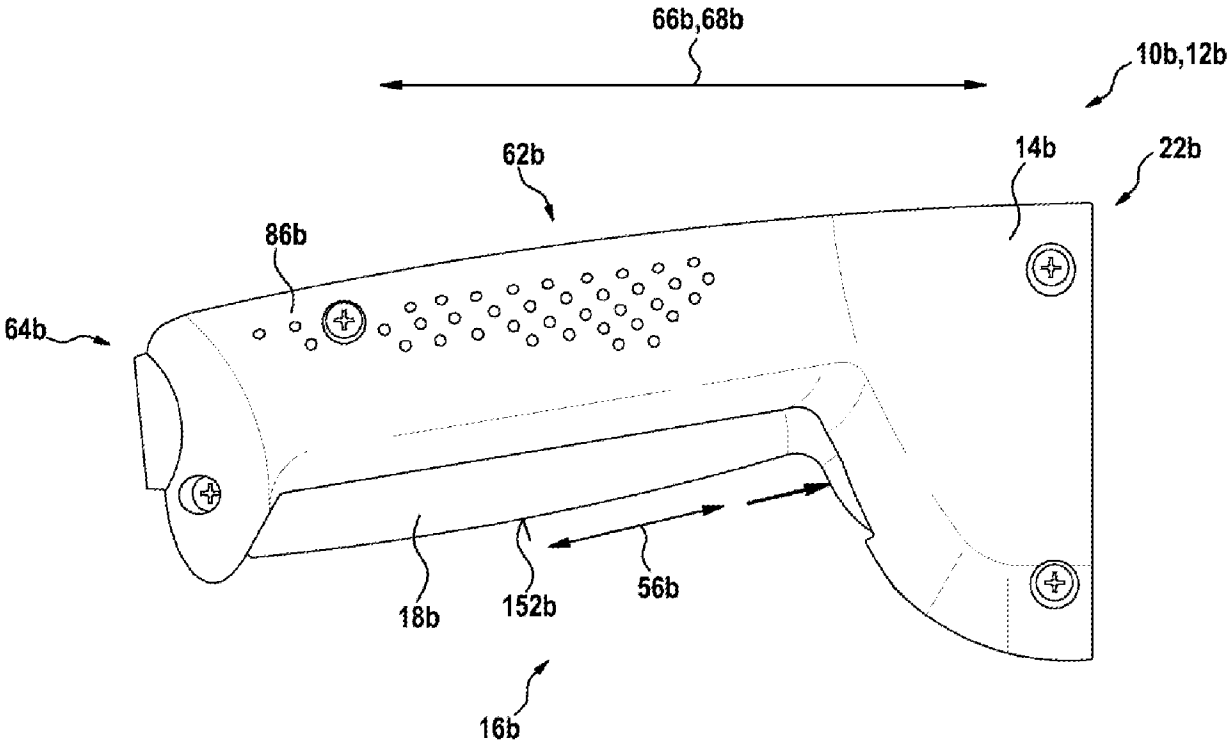
FIG. 8*b* shows a detail view of the latch element from FIG. 5 arranged on the handle housing, in an unlocking position, in a schematic representation.
Figure 8C:
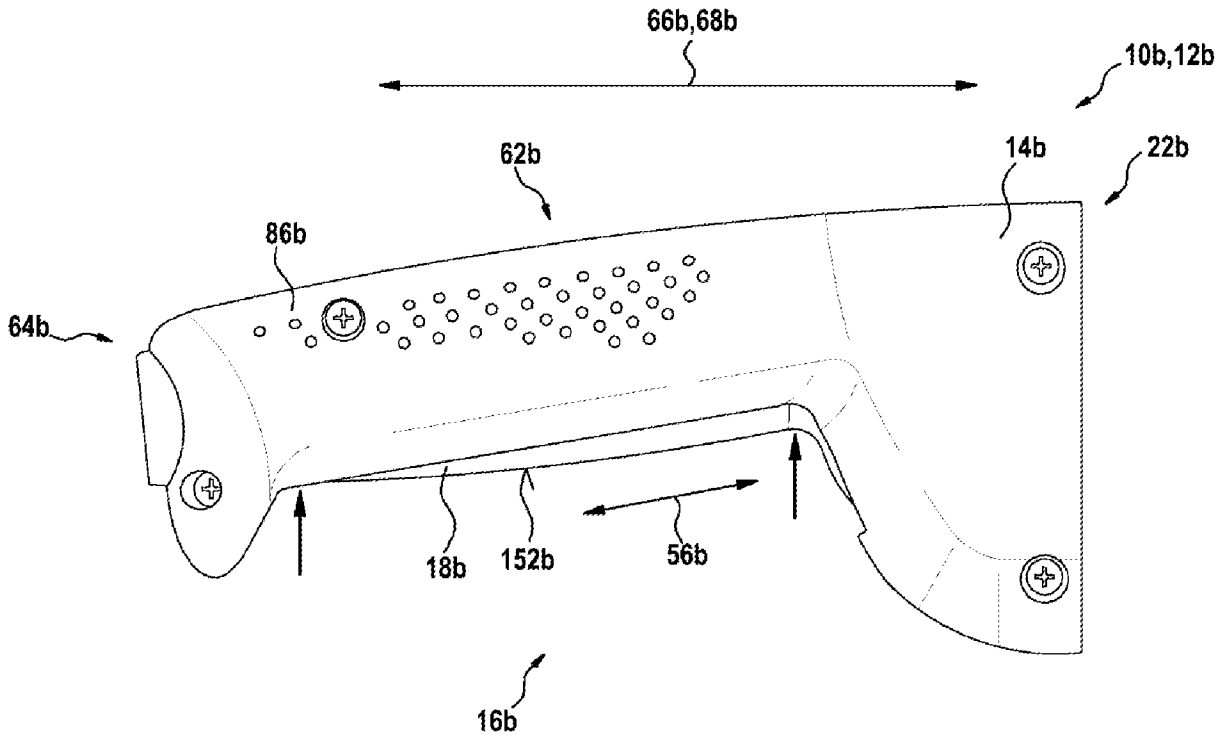
FIG. 8*c* shows a detail view of the latch element of the switching unit from FIG. 5 arranged on the handle housing, in a fully actuated state, in a schematic representation.

Thus, a pivot movement of the end 26*b* of the latch element 18*b* that can be gripped and that faces away from the connecting region 22*b*, about the pivot axis 118*b*, as a result of an action of force of an operator upon the latch element 18*b*, in a direction running at least substantially transversely in relation to the direction of longitudinal extent 56*b* of the latch element 18*b*, can be effected into the handle housing 14*b* (FIG. 8*c*), until the further bearing element 58*b* strikes against, or bears against, an edge region of the movement guide element 50*b* that delimits the limb 54*b* of the movement guide path 52*b* (FIG. 7). In this case, the actuating region 34*b*, realized as a switching tappet, of the switching element 36*b* is actuated by means of the switching region 162*b* of the latch element 18*b*, as a result of the pivot movement of the latch element 18*b* about the pivot axis 118*b*.

In this case, by means of the bearing unit 20*b*, a lever ratio, between the actuating region 34*b* of the switching element 36*b* and the latch element 18*b*, is achieved that is greater than 1 to 3.1. The lever ratio corresponds to a length of a distance measured from the pivot axis 118*b* of the latch element 18*b* as far as a central axis of the actuating region 34*b*, realized as a switching tappet, of the switching element 36*b*, in relation to a length of a distance measured from the pivot axis 118*b* of the latch element 18*b* as far as a point located in a central plane of an operating surface 152*b* of the latch element 18*b*.

The invention claimed is:

1. A power tool, comprising:

at least one handle housing defining an axis;

at least one switching unit supported by the at least one handle housing, the at least one switching unit including at least one latch element extending outwardly from the at least one handle housing; and at least one bearing unit supporting the at least one latch element so as to be movable relative to the at least one handle housing, wherein the at least one bearing unit is further configured such that, upon an actuation of the at least one latch element transversely to the axis, an end of the at least one latch element that faces toward a connecting region of the at least one handle housing and a further end of the at least one latch element that is configured to be gripped and that faces away from the connecting region move in a same direction relative to the at least one handle housing.

2. The power tool as claimed in claim 1, wherein the at least one bearing unit has at least one bearing element that is arranged at the end of the at least one latch element that faces toward the connecting region of the at least one handle housing.

3. The power tool as claimed in claim 1, wherein the at least one bearing unit has at least one bearing element that is arranged on a side of an actuating region of a switching element of the at least one switching unit that faces toward the connecting region of the at least one handle housing.

4. The power tool as claimed in claim 1, wherein the at least one bearing unit has at least one bearing element that is configured as a pin-type bearing element.

5. The power tool as claimed in claim 4, wherein the pin-type bearing element is configured so as to be integral with the at least one handle housing.

6. The power tool as claimed in claim 1, wherein the at least one bearing unit comprises at least one lever mechanism unit.

7. The power tool as claimed in claim 6, wherein the at least one lever mechanism unit is configured as a parallelogram lever mechanism unit.

8. The power tool as claimed in claim 1, wherein the at least one bearing unit comprises at least one lever mechanism unit, the at least one lever mechanism unit having at least one lever bearing element that actuates an actuating region of a switching element of the at least one switching unit in dependence on a movement of the at least one latch element.

9. The power tool as claimed in claim 1, wherein the at least one bearing unit comprises at least one lever mechanism unit, the at least one lever mechanism unit having at least one lever bearing element that is movably connected to the at least one latch element, at the end of the at least one latch element that faces toward the connecting region of the at least one handle housing.

10. The power tool as claimed in claim 8, wherein the at least one lever mechanism unit has at least one further lever bearing element arranged in a movable manner on the at least one latch element, the at least one further lever bearing element further arranged in a movable manner on a further bearing element of the at least one bearing unit that is arranged on a side of an actuating region of a switching element of the at least one switching unit that faces toward the connecting region of the at least one handle housing.

11. The power tool as claimed in claim 1, wherein the at least one bearing unit has at least one movement guide element that comprises at least one movement guide path having a course that is different from a pure rectilinear course.

12. The power tool at least as claimed in claim 1, wherein the at least one bearing unit has at least one movement guide element that comprises at least one movement guide path having an L-shaped course.

13. The power tool at least as claimed in claim 1, wherein the at least one bearing unit has at least one movement guide element that comprises at least one movement guide path having at least one limb that extends at least substantially transversely in relation to the direction of longitudinal extent of the at least one latch element.

14. The power tool at least as claimed in claim 13, wherein the at least one bearing unit has at least one movement guide unit that is configured to act in combination with a bearing element of the at least one bearing unit that engages in the at least one movement guide element so as to guide the at least one latch element during a movement.

15. The power tool as claimed in claim 11, wherein the at least one movement guide path of the at least one movement guide element is configured as a guide slot.

16. The power tool as claimed in claim 11, wherein the at least one movement guide element is configured so as to be integral with the at least one latch element.

17. The power tool as claimed in claim 11, wherein the at least one bearing unit is configured to enable at least one pivot movement, of a further end of the at least one latch element that is configured to be gripped and that faces away from the connecting region, into the at least one handle housing.

18. The power tool as claimed in claim 1, wherein the at least one switching unit has at least one spring element configured to apply a spring force of the at least one spring element to the at least one latch element in a direction of an initial position.

19. A power tool switching device of a power tool, comprising:

at least one switching unit; and at least one bearing unit supporting a latch element of the at least one switching unit in a movable manner relative to the power tool, wherein the at least one bearing unit is further configured such that, upon an actuation of the at least one latch element transversely in relation to a direction of longitudinal extent of the at least one latch element, an end of the at least one latch element that faces toward a connecting region of the power tool and a further end of the at least one latch element that is configured to be gripped and that faces away from the connecting region move in a same direction.

20. The power tool as claimed in claim 1, wherein the power tool is configured as an angle grinder.

* * * * *